US005187838A

United States Patent [19]

Fontana

[11] Patent Number: 5,187,838

[45] Date of Patent: Feb. 23, 1993

[54] JOINTED POCKET-BOOK TYPE CLOSING DEVICE FOR WATCH BANDS, BRACELETS, JEWELS AND THE LIKE

[75] Inventor: Fernando Fontana, Sesto Calende, Italy

[73] Assignee: G.T.F. S.r.l., Sesto Calende, Italy

[21] Appl. No.: 855,291

[22] Filed: Mar. 23, 1992

[30] Foreign Application Priority Data

Dec. 23, 1991 [IT] Italy ..... MI91A003449

[51] Int. Cl.[5] ..... A44C 5/00

[52] U.S. Cl. ..... 24/71 J; 24/68 J

[58] Field of Search ..... 24/71 J, 70 J, 69 J, 24/68 J, 265 WS, 629, 583, 585, 616

[56] References Cited

U.S. PATENT DOCUMENTS

| | | | |
|---|---|---|---|
| 1,696,167 | 12/1928 | King | 24/71 J |
| 1,821,507 | 9/1931 | Gammell et al. | 24/71 J |
| 1,985,835 | 12/1934 | Prestinari | 24/71 J |
| 1,997,723 | 4/1935 | Franklin, Jr. | 24/71 J |
| 2,532,840 | 12/1950 | Gaun | 24/71 J |
| 3,863,299 | 2/1975 | Hocq | 24/71 J |
| 4,675,955 | 6/1987 | Nakamura | 24/68 J |
| 4,928,359 | 5/1990 | Gagnebin | 24/71 J |
| 5,105,510 | 4/1992 | Roulin et al. | 24/68 J |

*Primary Examiner*—Victor N. Sakran

*Attorney, Agent, or Firm*—Bucknam and Archer

[57] ABSTRACT

The closing device consists of a frame (12) and opposed arms (14) with hook (18) designed to be inserted in the central bolt (20). In the latter, which is bounded below by the base (24) and above by the crosspiece (30) there is arranged in a sliding manner the plate (28) with openings (32), (36) and (34). The latter receives the spring (42) while in the openings (32) and (36) are engaged the hooks (18) of the arms (14).

The end (28') of the plate (28) is drawn manually outward and brings about simultaneous unhooking of the arms (14) to which are constrained the band branches.

Additional forms of embodiment call for the use of a bolt (60) with pushbutton (68) for simultaneous unhooking of the arms (54) and a bolt (90) with pushbutton (98) which moves opposed shaped plates (94), (94') which constrain the arms (84).

2 Claims, 3 Drawing Sheets

JOINTED POCKET-BOOK TYPE CLOSING DEVICE FOR WATCH BANDS, BRACELETS, JEWELS AND THE LIKE

DESCRIPTION

The present invention relates to a jointed pocketbook type closing device for watch bands, bracelets, jewels and the like.

With wrist-watches can be associated bands provided in different materials and variously structured.

As regards metal bands, which on valuable watches are proposed as elements of additional increase in value, there are distinguished two basic types which concern in particular the connection system for the opposed branches of the band.

Accordingly there are bands which require complete separation of the branches when opening. Other types require that the branches always remain connected together while opening however partially to permit removal of the watch from the wrist.

This second form of embodiment eliminates the danger of accidental falling and the resulting damage of the watch when positioning the watch on the wrist or removing it therefrom.

Known bands of this type are in general made up of opposing curved laminations hinged to the branches of the band so as to provide a closing device of the so-called 'pocket-book' type.

Said laminations are conventionally provided with hooks designed to engage upon closing of the band in specially created seats in a nucleus which constitutes the actual closing device.

These devices in general have the shortcoming that they require the user during opening of the band to operate separately on the ends of the two branches disengage them from the seats provided. This is usually not an easy and rapid operation as would be desirable.

The purpose of the present invention is to eliminate the shortcoming mentioned above.

The present invention as characterized in the claims solves the problem of creating a jointed pocket-book type closing device for watch-bands, bracelets, jewels and the like designed to connect in an effective manner both branches of the band to the closing device and especially allow opening of said device for removal of the watch from the wrist by rapid and simultaneous unhooking of said branches.

The advantages of the present invention are that the fastening members are simultaneously activated and align accurately the opposite branches of the band, constraining them to a central bolt easy to manufacture and assemble.

The invention is described in greater detail below with the aid of the annexed drawings which show some examples of embodiments.

Figure 1:
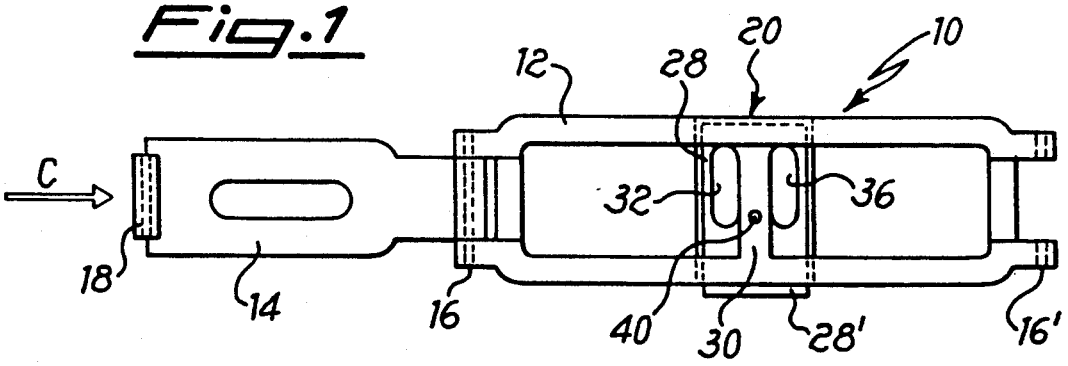
Figure 3:
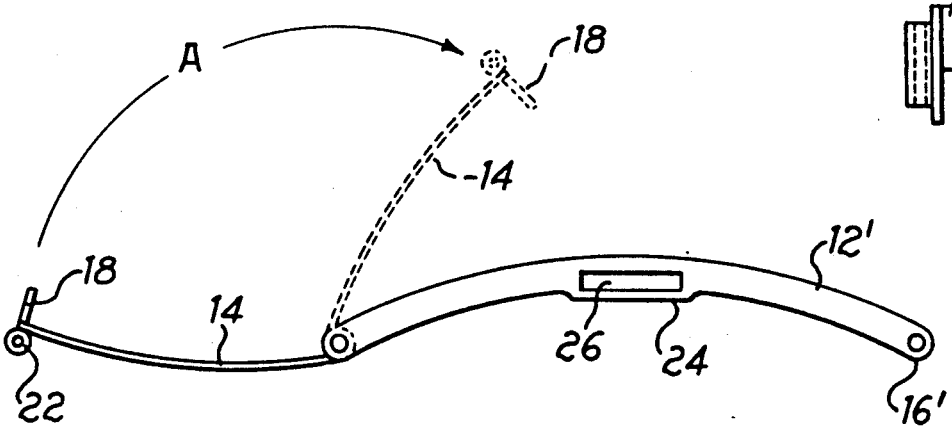
Figure 2:
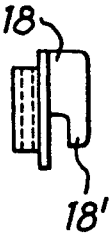
Figure 4:
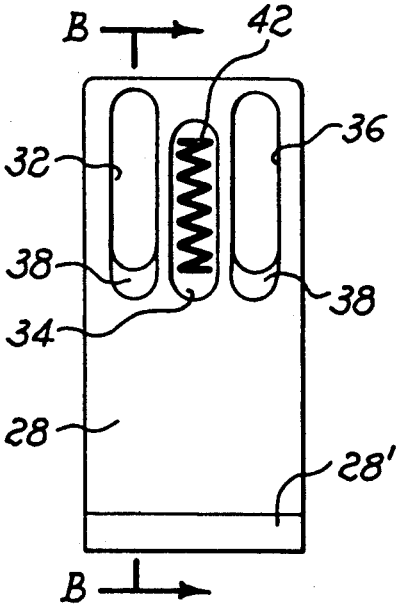
Figure 5:
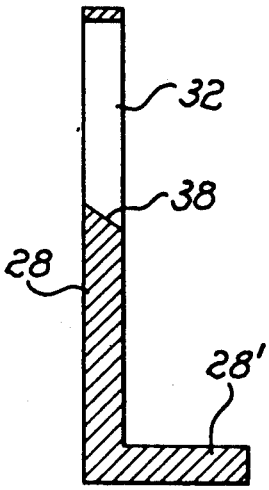
Figure 10:
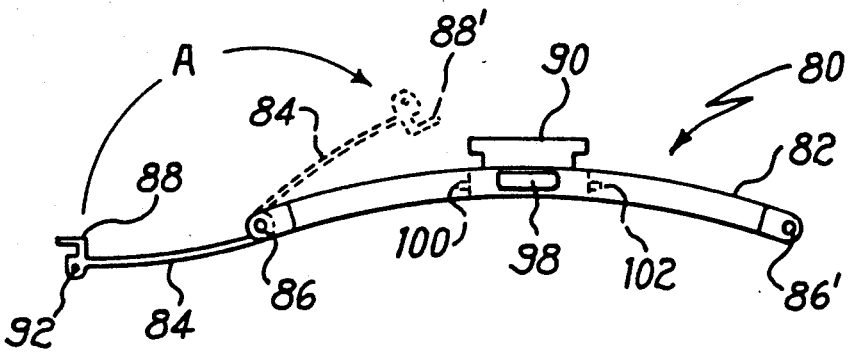
Figure 11:
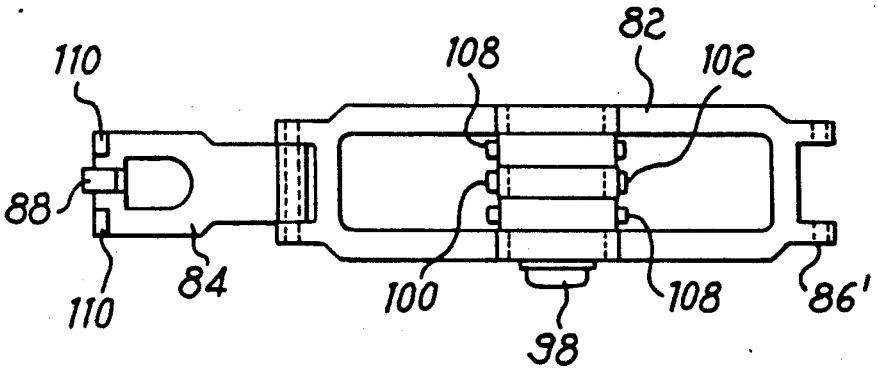
Figure 12:
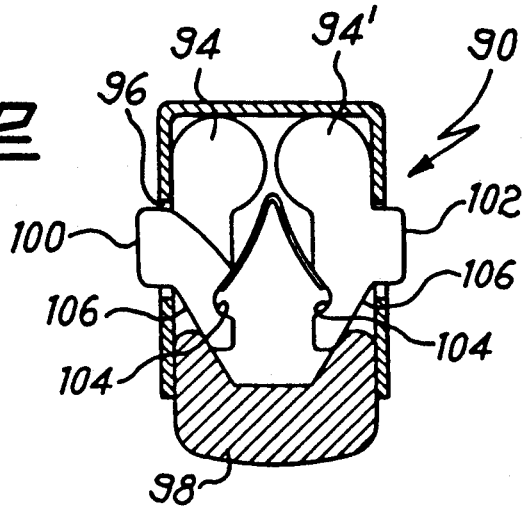

FIG. 1 shows a plan view of the closing device with movable plate housed in the box, FIG. 2 shows a side view of the hook arranged at each end of the lamination placed between the band branch and the closing device, FIG. 3 shows a side view of the closing device with reversible lamination and clamping hook, FIGS. 4 and 5 show a plan view and a longitudinal cross-section view respectively of the movable plate associated with the closing device, FIGS. 6, 7, 8 and 9 show an alternative form of embodiment of the closing device, and FIGS. 10, 11 and 12 show another form of embodiment of the closing device.

The figures show a jointed pocket-book type closing device for watch-bands, bracelets, jewels and the like and indicated as a whole by reference number 10 of FIG. 1 and comprising basically an arched frame 12, opposed arms 14 connected to the ends of said frame at 16 and 16' by generic pins and provided with a hook 18 substantially in the form of a carpenter's square and a bolt 20 preferably located in the center of the frame.

In FIGS. 1 and 3 is proposed by way of example a single arm 14 to be understood as present also on the opposite head and constrained at 16' by a pin to the frame 12. The latter is arched for better and optimal adaptation to the wrist.

To clarify the operation of the closing device described in detail below, the arm 14 is further shown in FIG. 3 in broken lines in a position near to aligning with the frame 12 and hooking with the element 18 to the bolt 20.

Each of the arms 14 made up of arched laminations similarly to the frame 12 displays width smaller than that of the frame to allow its housing without overlapping in the inner portion of the frame.

On the arms 14 in a position opposite the hook 18 is constrained a conventional cylindrical element 22 designed to receive a generic pin connecting the arms to the corresponding branches of the metal band (not shown).

The central bolt 20 consists of a base 24 applied centrally to the frame 12 on the side thereof which comes in contact with the wrist. Said base can be added, e.g. by welding, on the frame 12.

In this manner there is provided a box container projecting on the side which comes in contact with the wrist in a minimal measure so as to give no bother to the user.

On the branch 12' as shown in FIG. 3 there is created the opening 26 through which is introduced in the box container the plate 28 shaped like a carpenter's square. This plate once inserted is bounded below by the base 24 and above by the cross-piece 30 provided integrally with the frame 12.

The plate 28 displays three parallel through-passing openings 32, 34 and 36 in lozenge shape by way of example but not critically. The identical openings 32 and 36 are arranged laterally on the plate 28 and are longer than the opening 32 arranged centrally and have a countersunk bevel 38 designed to aid hooking of the elements 18 of the ends of the arms 14 during closing of the device as explained below.

In the opening 34 of the plate 28 before insertion of the latter in the box container there is housed a generic spring 42. After inserting, the plate with spring in the opening 34 is blocked in its seat by a screw or an equivalent retaining element inserted in the through-passing seat 40 which extends with threading in the base 24.

The end portion 28' of the plate 28 projecting from the box container constitutes the gripping point for sliding the plate which can be drawn outward for a limited distance by overcoming the resistance of the spring 42 arranged in the opening 34. This spring causes return of the plate 28 to its original position after release of the grip on the portion 28'.

The screw inserted in the seat 40, in addition to retaining the plate 28 in the box container, constitutes a barrier for the spring 42 placed in the opening 34.

There is described below operation of the device which allows simultaneous unhooking of the band branches during opening.

FIG. 3 shows the rotation movement in the direction indicated by the arrow A of the arm or arms 14 with fulcrum or fulcrums at 16, 16' the arm 14 being shown in broken lines in a position near total closure.

While the arms fold into the frame 12 the hook 18 provided at the end of each of them meets the corresponding lozenge-shaped seat 32 or 36 created in the plate 28. In particular the hook 18 of the arm 14 as shown in FIGS. 1 and 3 meets the seat 32 of the plate 28 shown in detail in larger scale in FIGS. 4 and 5.

By exerting a slight pressure on the arms 14 at the hooks, temporary and limited exposure outward of the plate 28 is caused, since the resistance of the spring 42 arranged in the opening 34 is overcome. Consequently the openings 32 and 36 also move outward, allowing the hooks 18, in particular at the end 18' thereof, to house in said openings aided by the countersunk bevels 38.

Immediately afterward the spring 42 arranged in the opening 44 retracts the plate 28 bringing it back to its original position. Effective hooking of the arms 14 to the frame 12 is thus provided since the end 18' of the hooks 18 was led to arrange itself below the plate 28.

Opening of the device and consequently of the band is very easy and fast. Limited withdrawal of the plate 28 from the exposed position 28' causes instant unhooking of the arms 14 because the hooks 18 under the effect of the withdrawal of the openings 32 and 36 are freed.

FIGS. 6, 7, 8 and 9 show an alternative embodiment of the closing device.

Figure 6:
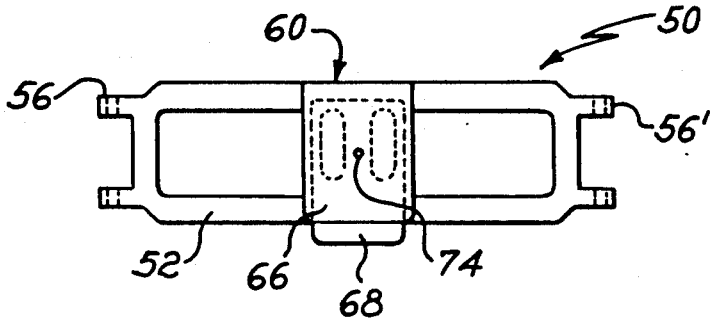

Similarly to the foregoing structure, the device, indicated as a whole by 50 in FIG. 6, consists fundamentally of an arched frame 52, opposite arms 54 with hook 58, connected to the frame by pins at 56 and 56' and by a central bolt 60. In the cylindrical elements 62 arranged at the end of the arms 54 in a position opposed to the hooks 58 are arranged the usual pins for connection of the arms to the branches of the metal band, not shown.

The bolt 60 is preferably provided in a central position on the frame 52 and consists of a base 64 with slightly bent back edges to create a box container open on one side and on the upper head. This base is made integral with the frame 52 on the side which comes in contact with the wrist by welding or equivalent system. This welding can involve totally or only partially the portions of the base in contact with the frame.

In this container is positioned the substantially rectangular plate 66 whose end 68 emerges, constituting the operating pushbutton of the device during opening as explained below.

The plate 66 displays two parallel openings 70, 70' shaped preferably like lozenges and facing the upper side of the frame 52. Once inserted in the box container said plate is bounded below by the base 64 and above by the cross-piece 72 provided integrally with the frame 52.

Inside the box container arranged on the bottom thereof is housed a spring of the conventional type or of elastic lamination (not shown) met by the plate 66 with its end opposite the portion 68.

To prevent it slipping out of the seat made up of the box container, the plate is provided with appropriate protrusions designed to meet the frame 52 from the inside.

An analogous result can be advantageously achieved in accordance with that shown in FIG. 6 by means of a pin 74 which meets an adequate cavity created in the plate between the openings 70 and 70' or by means of a screw or the like inserted in a through-passing seat created in the cross-piece 72 in the plate 66 in the form of a cavity and in the base 64.

There is now described operation of the device which provides safe closing of the band branches and simultaneous unhooking thereof upon opening.

Figure 7:
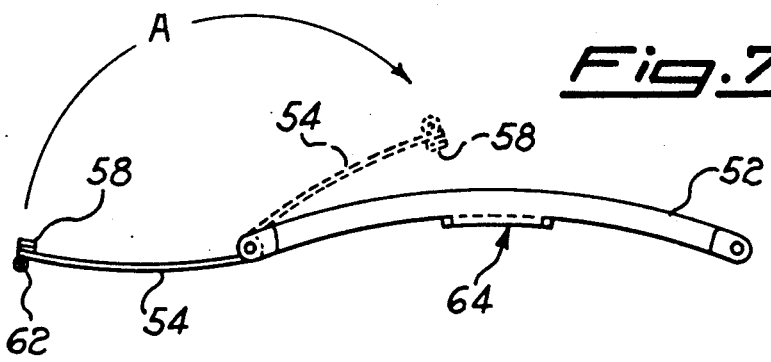
Figure 9:
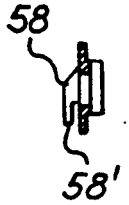
Figure 8:
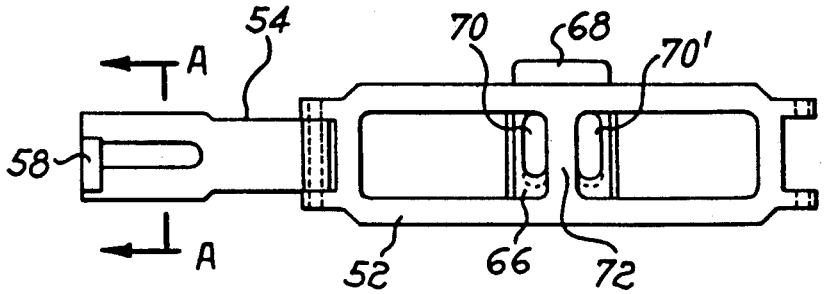

An examination of FIG. 7 shows the rotary movement in the direction indicated by the arrow A of the arm or arms 54, the latter being shown in broken lines in a nearly fully closed position. Folding back of the arms leads the hook 58 provided at the end of each of them to meet the corresponding seat 70 or 70' provided in the plate 66. The slight pressure exerted on the arms 54 even with the hooks 58 causes withdrawal of the plate 66 which is further inserted to a limited extent in the box seat, overcoming the resistance of the spring arranged on the bottom. In this manner the openings 70 and 70' are almost entirely exposed. In FIG. 8 the position which these openings take up in said circumstance is shown schematically in broken lines.

The end 58' of the hooks 58 is therefore housed in the openings 70 and 70'. The operation is facilitated by the radial structure of the end of the hooks. Immediately afterward the port in the openings is brought back to the original size. The spring again pushes the plate 66 outward, inserting it partially beneath the hooks 58.

The reverse operation, which opens the opening in the device, is extremely easy and immediate; the simple and moderate pressure exerted on the pushbutton 68 or exposed end of the plate 66 leads to simultaneous and momentary extension of the lozenge openings 70 and 70' with resulting instantaneous unhooking of both the arms 54 whose hooks 58 are then free to rise again.

FIGS. 10, 11 and 12 show another variation of the closing device.

Said device, indicated as a whole by 80 in FIG. 10, consists, similarly to the preceding ones, of an arched frame 82, opposed arms 84 connected to the heads of said frame, jointed at 86, 86' and provided at the end with a hook 88 substantially in the shape of a carpenter's square as well as a central bolt 90 shown in detail in FIG. 12 in partially sectioned plan view.

FIGS. 10 and 11, which show the device with the various members in side and plan view, propose by way of example a single arm 84, also understood to be present on the opposite head, constrained at 86' to the frame 82. This arm is further shown in FIG. 10 in broken lines in almost fully overturned position to make clear the closing system of the device described herein.

The arms 84 are provided at the end 92 with an adequate seat for insertion of a conventional connecting pin to each of the metal branches (not shown) of the band.

The central bolt 90, preferably in the shape of a substantially parallelepiped container 112 of limited height and open on one side is constrained by welding or equivalent means to the upper portion of the frame 82. This bolt is then positioned on the side opposite that which comes in contact with the wrist and displays internally a pair of opposed shaped plates 94, 94', a spring 96 arranged between said plates as well as a pushbutton 98. The latter emerges partially from the open front side of the container 112 and constitutes the activation member of the bolt 90.

On each of the flanks of the container 112 is made a slit through which emerges one of the segments 100 and 102 of the plates 94, 94'. The structure indicated by way of example of the latter can be seen in FIG. 12. In a position opposite that of said segments 100 and 102 is provided on both the plates 94 and 94' a concave seat 104 in which are housed the open ends of the spring 96 preferably shaped like the letter V.

The container 112 is provided with a cover (not shown) constrained to the container with screws or equivalent systems. On the inside of the cover is provided a generic striker for the pushbutton 98 which therefore cannot slip out of the container 112. The pushbutton 98 is consequently capable of retaining exactly in position the spring 104 and the plates 94, 94'. The latter are already considerably stabilized inside the container since the segments 100 and 102 of the plates 94 and 94' are pushed outward through the slits by the spring 96.

This arrangement of the various members making up the bolt 90 is particularly advantageous since it allows rapid assembly of said bolt. The plates 94 and 94' display even with the zone 106 which comes in contact with the pushbutton 98 an inclined part aligned with the structure created on the inside of the pushbutton.

There is described now the operation of the closing device.

Starting from the position in which the device is open, illustrated in FIGS. 10 and 11, the device is brought rapidly to the closing position by mere rotation of the arms 84, which fold back inwardly. FIG. 10 shows in broken lines the position which the arm 84 assumes by rotating progressively in the direction indicated by the arrow A.

When the arms are in contact with the bolt 90 the hook 88 of each of them meets the corresponding exposed segments 100 and 102 of the shaped plates 94 and 94'. A slight pressure overcomes the resistance thereof which return momentarily inside the container 112 while compressing the spring 96. Immediately afterward, as the spring is released, the segments emerge and go to overlie the hooks 88, inserting themselves in the seats 88' thereof.

To aid accurate alignment between the arms 84 and the frame 82 it is provided that the latter be equipped above or below the corresponding exposed segments 100 and 102 with striker seats o bases 108 for the end portions 110 of the arms 84.

The device is opened by means of the pushbutton 98 projecting from the container 112 and causes simultaneously the segments 100 and 10 to return inward temporarily. This operation is facilitated by the complementary form of the inside of the pushbutton 98 and the portions 106 created on the plates 94 and 94'. The pushbutton slides at 106 and causes momentary return inward of the exposed segments 100 and 102. Consequently the hooks 88 are free to return upward, causing opening of the device.

As may be seen by the foregoing the multiple advantages of the invention are clear. By a single operation of compression or partial exposure of the pushbutton emerging from the bolt it is possible to simultaneously free the hooks of the arms connected to the branches of the band and achieve consequently rapid opening of the device. Closing of the latter in all the embodiments proposed is particularly effective. The central bolts lastly shown by way of example display characteristics of constructive simplicity and rapidity of assembly.

The invention as described above and claimed below is proposed merely by way of example and it is understood that it can be subjected to numerous modifications and variations all falling within the scope of the inventive concept.

In particular the closing device, although proposed primarily for metal watch bands, can also be associated with other articles such as for example bracelets, jewels in general and the like.

I claim:

1. A closing device for watch bands, bracelets, jewels and the like comprising a supporting frame (12) for supporting a bolt (20), opposite arms (14) hinged to said frame, each of said arms having a hook (18,18') at the end thereof, said bolt (20) consisting of a base (24), integral with one side of the frame (12), whereby a box container is formed, a movable plate (28) located in said container, said plate having a projecting end (28') for movement, said movable plate (28) being bounded below by base (24) and above by cross-piece (30), said plate being retained in said container by a screw or pin in a seat (40), said screw or pin being inserted through the frame (12) in the base (24), said plate (28) having first openings (32), (36) with countersunk bevel (38) and a second central opening (34) of reduced extension arranged parallel to said two first openings, a spring (42) located in said central second opening, said spring meeting said screw or pin and holding said plate in elastic tension, said hooks (18,18') being inserted in said two first openings.

2. The device according to claim 1 wherein said frame (12) is arch-shaped, said bolt (20) is located in the center of said frame, and axial displacement of said plate causes withdrawal of said plate from said projecting end (28') and simultaneously unhooking of said arms (14) connected to the frame (12) and opening of said device.

* * * * *